United States Patent [19]

McGee

[11] 4,289,199

[45] Sep. 15, 1981

[54] WELLHEAD SIDEWALL ELECTRICAL PENETRATOR

[75] Inventor: John K. McGee, Houston, Tex.

[73] Assignee: Combustion Engineering, Inc., Windsor, Conn.

[21] Appl. No.: 79,954

[22] Filed: Sep. 28, 1979

[51] Int. Cl.[3] ..... E21B 33/03

[52] U.S. Cl. ..... 166/65 R; 166/85; 166/88; 339/60 C

[58] Field of Search ..... 166/88, 89, 65 R; 339/15, 60 C, 117

[56] References Cited

U.S. PATENT DOCUMENTS

| | | | |
|---|---|---|---|
| 3,043,371 | 7/1962 | Rector | 166/88 |
| 3,638,732 | 2/1972 | Huntsinger | 166/65 |
| 3,965,977 | 6/1976 | Beson | 166/88 |
| 4,154,302 | 5/1979 | Cugini | 166/65 R |
| 4,181,175 | 1/1980 | McGee | 166/88 |

*Primary Examiner*—William F. Pate, III

*Attorney, Agent, or Firm*—Cushman, Darby & Cushman

[57] ABSTRACT

The present invention provides a penetrator for a wellhead in order to get a communication line for a down hole device out of a well through the wellhead. In particular, the line is brought up into the hanger for less than the full axial extent of the hanger, then led laterally out through the side of the hanger and out through the sidewall of the head below the hanger-to-head annulus seal. The communication line may be an electrical cable with particularly placed connecting fittings in the hanger and head and is shown providing for side access for easy, horizontal plug-in installation.

4 Claims, 4 Drawing Figures

20
30
84
146
90
92
96
102
100
100
140
144
98
98
144
146
82
106
88
104
116
88

140
144
144

WELLHEAD SIDEWALL ELECTRICAL PENETRATOR

This invention relates to apparatus for providing a way to make an electrical connection or the like through a wellhead between a device in a well, and a point externally of the wellhead, via a wellhead sidewall penetration.

SUMMARY OF THE INVENTION

Various down hole devices provided or used in wells, particularly petroleum wells are made to be operated from the surface, externally of the wellhead. Typical of such down hole devices is a down hole pump for a string of production tubing. Communication lines are required for providing power and/or control signals between the control station located externally of the well and the down hole device. Sometimes down hole devices are fluid pressure-operated so that the necessary communication lines are or include tubing lines for communicating power and/or control to the device. Other down hole devices are made to be electrically powered and/or controlled, so the communicating lines include electrical cables. Combinations and equivalent possibilities are evident. In each instance, some special provisions need to be made where the communication line penetrates the well, e.g. at the wellhead. Some possible arrangements may lead to difficulties in performing the other necessary steps in the completion of a well, such as causing hinderance to further assembling and testing of the wellhead. Some arrangements may require the use of a large and complex bonnet, i.e. when the penetration is axially through the tubing hanger. The latter arrangement may also be disadvantageous in some instances due to its representing another passageway clear through the tubing head. In addition, where the mechanical parts of the tubing head, e.g. the bonnet and seals must be assembled before the soundness of the electrical connection through the penetration can be tested, the task of assembling, testing, taking-apart and reassembly can prove frustrating and expensive.

SUMMARY OF THE INVENTION

The present invention provides a penetrator for a wellhead in order to get a communication line for a down hole device out of a well through the wellhead. In particular, the line is brought up into the hanger for less than the full axial extent of the hanger, then led laterally out through the side of the hanger and out through the sidewall of the head below the hanger-to-head annulus seal. The communication line may be an electrical cable with particularly placed connecting fittings in the hanger and head and is shown providing for side access for easy, horizontal plug-in installation.

"Tubing head", "tubing hanger" and "tubing" are illustrative terms as used herein, since the invention may be used at the equivalent site on a casing head/casing hanger interface.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
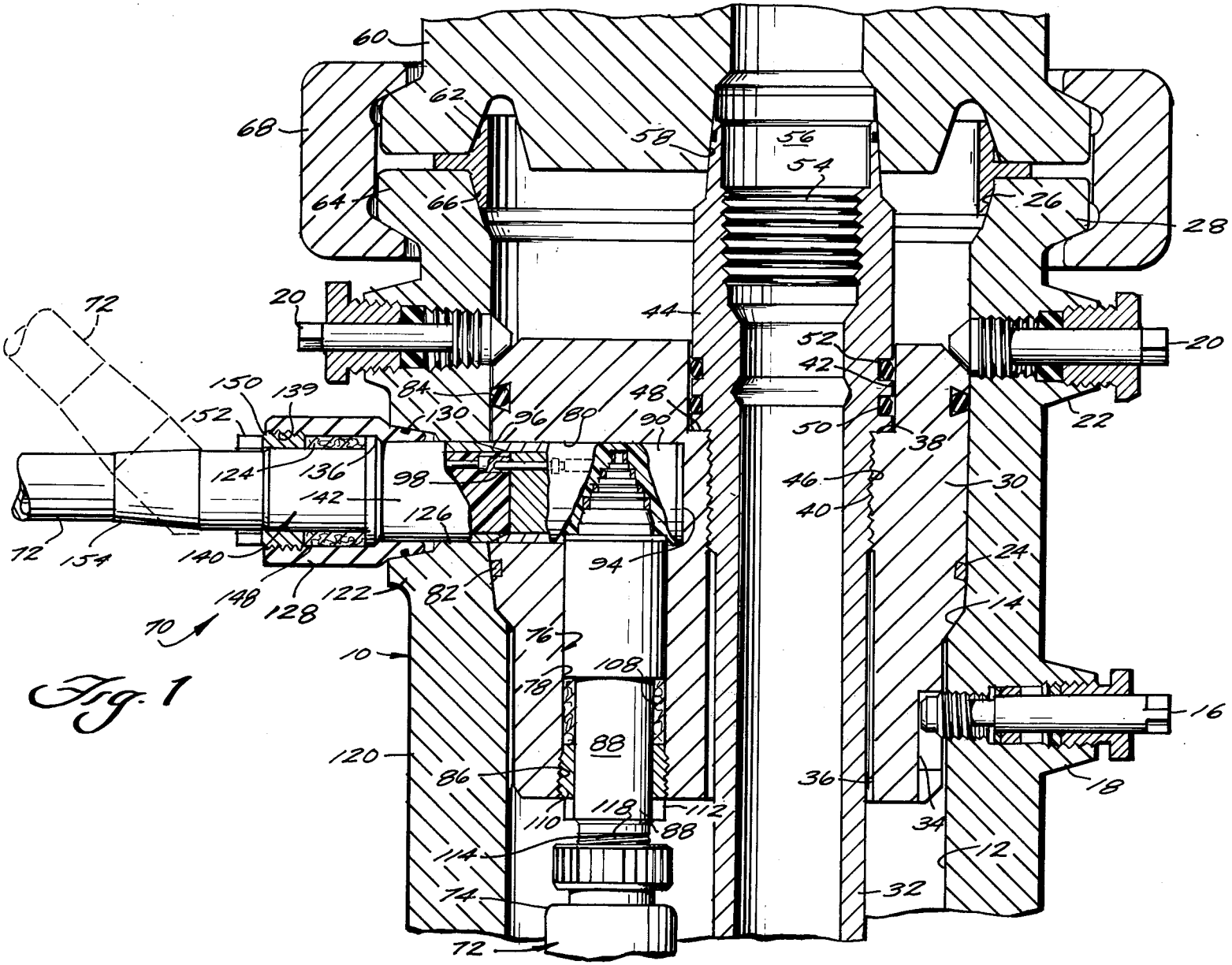
FIG. 1 is a fragmentary longitudinal sectional view of a wellhead equipped with a penetrator of the present invention.
Figure 2:
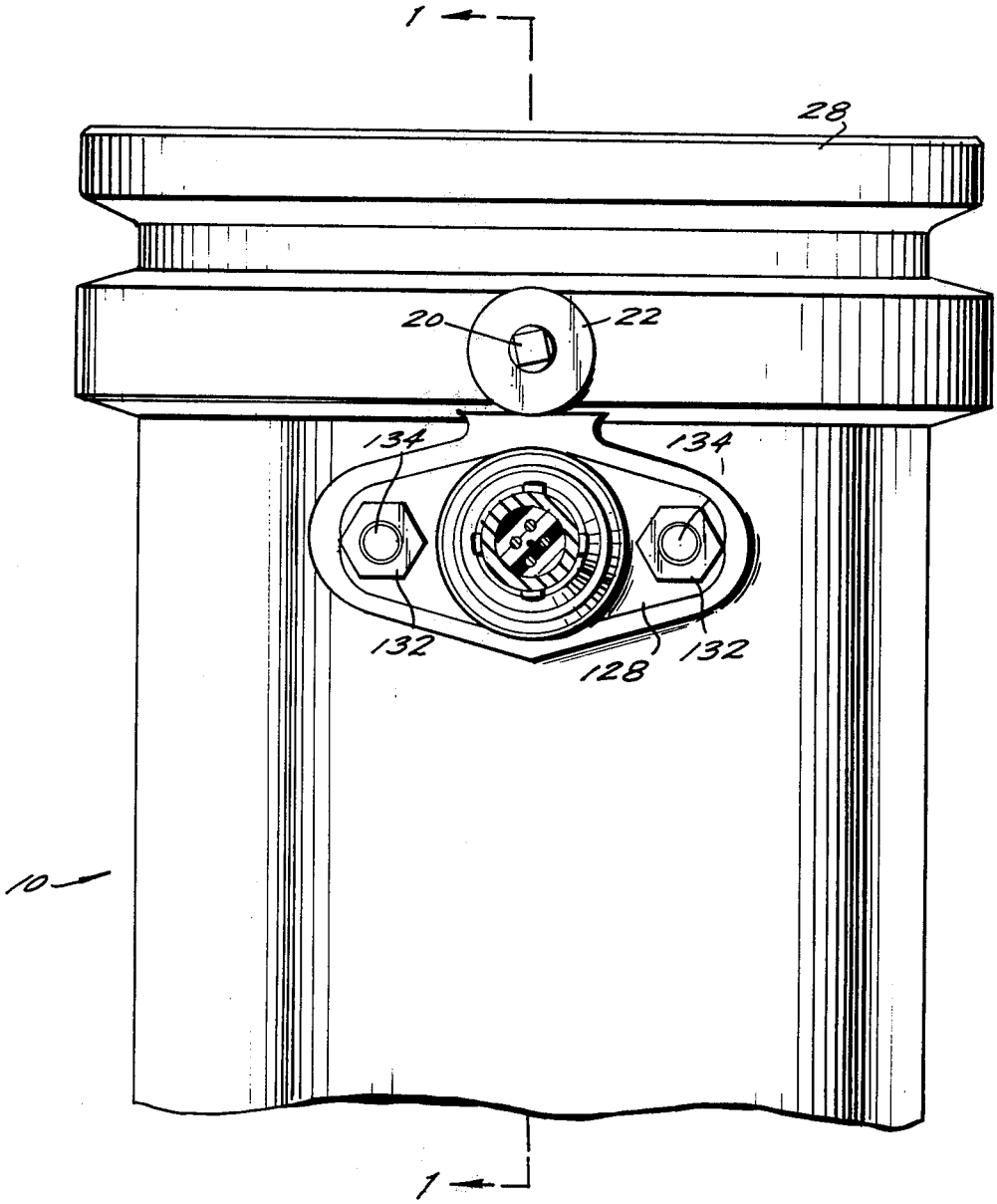
FIG. 2 is a fragmentary side elevation view thereof.
Figures 3, 4:
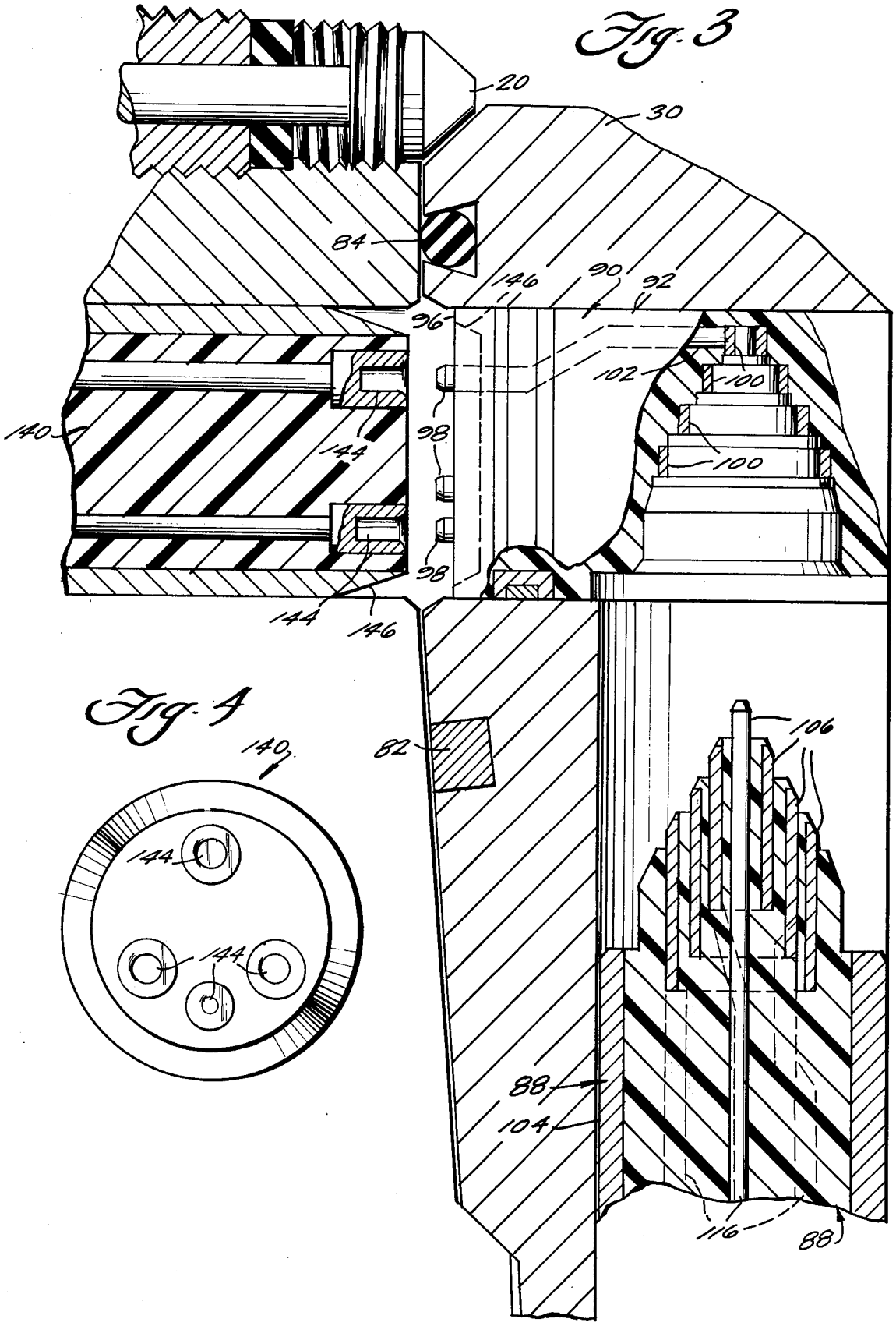
FIG. 3 is an enlarged scale, more fragmentary longitudinal sectional view of the wellhead showing further details of the penetrator.
FIG. 4 is an end elevation view of the horizontal connector of the penetrator.

FIG. 1 shows a tubing head at 10. This may be a separate structure mounted on a lower wellhead part such as a casing head, or may be the upper portion of a unitary head for both one or more casing hangers and a tubing hanger.

The tubing head 10 has a longitudinal bore 12 having a tubing hanger seat 14. Below the seat 14, the head 10 is provided with one or more alignment screws 16. Each, as is conventional, is projected and retracted via a respective sidewall port 18 in which it is sealingly received. Above the seat 14, the head 10 is provided with a plurality of hanger hold-down screws 20. Each, as is conventional, is projected and retracted via a respective sidewall port 22 in which it is sealingly received. A circumferential tapered sealing surface 24 is also shown provided in the bore above the seat 14.

At its upper end, the head 10 bore is provided with an internal circumferential tapered sealing surface 26 for sealing with a tubing bonnet and the head is provided with an external flange 28 for mounting the bonnet on the tubing head.

At the stage depicted in FIG. 1, a tubing hanger 30 has been lowered in the tubing head at the upper end of a tubing string 32, given predetermined angular orientation and kept there by receipt of the projected alignment screw 16 in a downwardly and outwardly opening slot 34 provided in the hanger. The tubing hanger has a longitudinal bore 36 which in this instance is radially offset somewhat from the longitudinal center line of the hanger. The bore 36 has a circumferential seat at 38 with a band of internal threading 40 below that seat and a sealing surface 42 above it. The tubing string 32 has at its upper end an enlarged tubular hanger insert 44 which fits in the bore 36. These two parts are threaded together via threading at 46. The insert 44 seats on the bore seat 38 via shoulder 48 and seals with the bore sealing surface 42 via seal rings 50 carried in circumferential grooves 52 therein.

The lowering of the hanger and string together is accomplished by use of a lowering joint (not shown) temporarily threadably mounted in the band of internal threading 54 in the bore 56 of the hanger insert 44. The hanger insert shown is one that is adapted to receive a tubing back pressure valve (not shown). At its upper end of the hanger insert 44 is provided with a tapered sealing surface at a spigot end for sealing in the comparable bore 58 of a tubing bonnet 60.

The bonnet 60 is shown conventionally provided with an internal sealing surface 62 and an external circumferential flange 64. A seal ring 66, e.g. a Grayloc sealing ring of Gray Tool Company, Houston, Tex., is received between the tubing head bore and the bonnet and a clamp 68 is externally installed on the tubing head and bonnet end flanges. As the clamp 68 is tightened on the flanges 28, 64, the two parts are connected together and the seal ring 66 circumferentially seals at 26, 62.

What should now be given attention is that the fairly conventional installation as so far described is also provided with a communication line penetrator 70, e.g. a wellhead electrical penetrator for a communication line 72 such as an electrical cable.

Down in the well is a device (not shown), for instance a pump incorporated in the tubing string 32. For instance it may be made up on or near the lower end of the tubing string, and have the lower end (not shown) of the communication line 72 operatively connected therewith. In such an instance this connection would be tested before the tubing string is lowered into the well. During the lowering process, as the tubing string is made up or uncoiled, the communication line is strapped thereto every so many feet. Within the well, the communication line 72 may be in one continuous length, or may be in several lengths connected end to end by conventional connectors. Laterally corresponding to where the tubing string at its upper end projects up into the bore 56 of the hanger, the communication line 72 within the well is provided with a connector 74. This may be done by field cutting and splicing the connector 74, while it must be one which will mate with the penetrator of the invention may have a standard layout. What is shown at 74 is a standard four-pin electrical connector with a knurled internally threaded collar which is used to mechanically secure the connector 74 to the penetrator.

The tubing hanger 30 is shown provided with a penetrator passageway 76 having a vertical leg 78 which opens out the axially lower end of the hanger, laterally offset from the bore 56. Intermediate the upper and lower ends of the hanger 30, the vertical bore leg 78 ends and communicates with the radially inner end of a lateral leg 80. The lateral bore leg 80 opens laterally out through the side of the hanger 30 vertically intermediate the circumferential seals 82, 84 of the tubing hanger with the tubing head bore. In the instance shown, both bore legs 78, 80 are cylindrical and the vertical one is internally threaded at 86, adjacent the lower end of the hanger 30.

Two elements 88, 90 of the penetrator are shown mounted in the respective bore legs 78 and 80. (These may be mounted in place at the plant where the hanger 30 is made, or by the supplier, or may be assembled to the hanger at the well site before the hanger is lowered into the head.)

The penetrator element 90 includes a generally cylindrical body 92 snugly slidingly received in the lateral bore leg 80 until its inner end 94 abuts the inner end of the lateral bore leg 80 and its outer end 96 lines inside the mouth of the lateral bore leg 80. The outer end 96 is shown provided with a standard male four-conductor arrangement of electrical connector pins 98 which project axially of the body 92 but laterally, e.g. horizontally of the tubing hanger. Near its inner end, and in axial alignment with the vertical bore leg 78, the penetrator element 90 is shown provided with a female four-conductor coaxial arrangement of tubular electrical contacts 100. Within the body, each pin 98 is electrically connected with a respective contact 100, e.g. by a respective wire 102. Electrical insulation is maintained among the several electrical paths 98, 102, 100 by making appropriate parts of electrically insulating material.

The penetrator element 88 includes a generally cylindrical body 104 snugly slidingly, upwardly received in the vertical bore leg 78 from the lower end. The upper end of the penetrator element 88 is shown provided with a male four conductor coaxial arrangement of tubular electrical contacts 106, which, when the penetrator elements 88, 90 are in place as shown, mate with the respective electrical contacts 100. In this sense, the penetrator element 88 sockets in or plugs into the penetrator element 90.

The lower end of the body 104 is radially relieved somewhat, so that the inserted penetrator element 88 may be followed in the bore leg 78 by a coaxially tubular assembly of packing 108. The packing 108 is axially compressed and radially expanded into a sealing relation between the vertical bore leg 78 and the body 104 by threading a coaxial packing gland 110 into the lower end of the vertical bore leg 78, for which purpose wrenching lugs 112 are provided on the gland 110.

The lower end 113 of the body 88 lies accessable at the lower end of the hanger, and is provided with a connector 114, which is of the possibly standard type for mechanically and electrically mating with the connector 74. Within the body 88, each electrical contact 106 is electrically connected with a respective pin, socket or the like (not shown) at the penetrator element lower end 113, e.g. by a respective wire 116. Electrical insulation is maintained among the several electrical paths by making appropriate parts of electrically insulating material. External threading is shown at 118 for making a mechanical connection between the penetrator element 88 and the connector 74 provided at the upper end of the portion of the electrical cable 72 that extends down within the well.

At a comparable level to where the horizontal bore leg comes out the side of the tubing hanger, the tubing head sidewall 120 has a side port 122 with a bore 124 passing laterally therethrough in axial alignment with the penetrator bore leg 80 as a radially outward extension thereof through said tubing head sidewall to the exterior of the wellhead. The penetrator side port 122 may be provided as an integral boss (not shown), or, as depicted, part of it may be provided by forming a suitable opening 126 through the sidewall and the rest by mounting a separately manufactured side outlet fitting 128 in that opening 126 from the outside. The fitting 128 is sealed to the tubing head in the opening 126 at 130 and is secured to the tubing head, e.g. via nuts 132 threaded on studs 134 mounted in the head to project outwardly beside the opening 126 for this purpose.

The bore 124 is cylindrical, enlarged at 136 and internally threaded at 139 near its outer end.

After the tubing string has been run and the tubing hanger has been aligned and landed and the hold-down screws 20 have been run in, the pins 98 are projecting axially toward the bore 124 and accordingly the third element 140 of the penetrator 70 may be installed. This third element includes a generally cylindrical body 142 snugly slidingly received in the bore 124. The radially inner end of the body is provided with a set of electrical connectors, e.g. a standard four-conductor socket arrangement 144. Appropriate tapered guiding surfaces 146 may be provided so that as the element 140 is pushed into the bore 124, its sockets 144 receive and mate with the respective pins 98 to make respective electrical connections.

As with the element 88, the element 140 is followed into the bore 124 by a coaxially tubular packing assembly 148 and a packing gland 150 is threadably tightened into place from the outside, using wrenching lugs 152 in order to provide a penetrator-to-side outlet seal at 148. As shown the connector 140 extends to the external environment beyond the gland 150 and here it may be connected by any conventional means 154 to the electrical cable 72 outside the well. This electrical cable outside the well extends to a remote control location from which the down hole device at the other end of the electrical cable may be powered, controlled and/or monitored. In solid lines the conventional connector is shown extending horizontally, straightly. In dashed lines a possible variation in appearance is illustrated, where the conventional connection to the electrical cable is a pigtail that angles upwards.

A typical installation procedure for the apparatus of FIG. 1 is summarized as follows.

A. Install down hole pump on tubing string.

B. Run tubing, strapping power cable to tubing as it is lowered into hole.

C. Make up tubing hanger onto tubing string.

D. Field splice connector to power cable if necessary.

E. Make up connector from power cable to bottom of tubing hanger.

F. Lower tubing hanger into tubing head bowl indexing hanger with retractable alignment pin.

G. Run in hold down screws to secure hanger in place.

H. Close B.O.P. rams on landing string and test tubing hanger annulus seals.

I. Remove electrical side port blanking plug.

J. Remove trash seal from electrical contacts in side of tubing hanger.

K. Plug in electrical connector into side port of tubing head.

L. Make up bolting on side port.

M. Pressure test connection.

N. Electrical test isolation and conductivity of power cable.

O. Install flow section of assembly.

P. Test hanger and flange ring joint seals.

The apparatus of the present invention provides side access to the electrical contacts on the outside of the tubing head, permits a hanger seal test without nipple down, permits the communication line to be assembled with the penetrator and tested prior to installation of the bonnet permits a shorter and less complex bonnet to be used, provides side connection without completing through a port that would violate the tubing hanger annulus seal, provides for easy horizontal plug-in installation.

The penetrator elements 88 and 90 may be permanently installed so as to become an integral part of the hanger, or may be removably installed as described. While the penetrator should enter the hanger substantially vertically from below and emerge substantially horizontally along a radius of the hanger, some variation from these orientations obviously would be workable, if accommodated. The nature and number of the pins, sockets, wires and the like of the communication line and penetrator are exemplary since the invention clearly has implications beyond penetrating merely four conductor electrical cables.

It should now be apparent that the wellhead sidewall electrical penetrator as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A wellhead sidewall communications line penetrator arrangement for linking a communication line that is to extend within a well to a down hole device with a communication line which is to extend outside the well to a remotely located control site, said penetrator arrangement comprising:

a tubing head having a throughbore with a tubing hanger seat therein:

a tubing hanger having a throughbore means for hangingly supporting a tubing string;

said tubing hanger further having a shoulder for seating the tubing hanger on said tubing hanger seat, and means cooperable with the tubing head for providing and fixing a predetermined angular orientation of the tubing hanger relative to the tubing head;

means defining a penetrator passageway extending into the tubing hanger from the axially lower end of the tubing hanger and laterally, at least generally horizontally, out of the tubing hanger through the side of the tubing hanger below the axially upper end of the tubing hanger;

sealing means for sealing between the tubing head throughbore and the tubing hanger in such a sense as to seal off a vicinity surrounding where the penetrator passageway emerges out the side of the tubing hanger;

means defining a penetrator passageway extension in the form of a bore extending laterally, at least generally horizontally, through the tubing head from the throughbore of the tubing head to the exterior of the tubing head;

a first penetrator portion comprising a body means having a lower end and an outer end and with at least one communication line communicating member extending from said lower end to said outer end, said at least one communication line member being provided with a communication line connector means at each end thereof;

said first penetrator portion being configured for installation in said penetrator passageway so that its lower end is accessable from the axially lower end of tubing hanger and so that its outer end lies within said penetrator passageway near the outer end of said penetrator passageway;

packing and packing activation means installable about said first penetrator portion in said penetrator passageway for forming a circumferential seal between said first penetrator portion and said tubing hanger within said penetrator passageway;

a further penetrator portion comprising a body having an inner end and an outer end with at least one communication line communicating member extending from said inner end to said outer end, said at least one communication line member being provided with a communication line connector means at each end thereof;

said communication line connector means at the lower end of said first penetrator portion being configured for connection with said communication line that is to extend within said well;

said communication line connector means at the outer end of said first penetrator portion being configured for connection with said communication line connector means at the inner end of said further penetrator portion;

said communication line connector means at the outer end of said further penetrator portion being configured for connection with said communication line that is to extend outside said well to a remotely located control site;

packing and packing activation means installable about said further penetrator portion in said penetrator passageway extension for forming a circumferential seal between said further penetrator portion and said tubing head within said penetrator passageway;

said penetrator passageway including a vertical leg which intersects a lateral leg within the tubing hanger; and said first penetrator portion comprising a vertical penetrator element extending in the vertical leg of the penetrator passageway, and a lateral penetrator element extending only in the lateral leg of the penetrator passageway, the vertical and lateral penetrator elements being operatively plugged together within the penetrator passageway via connector means provided on each of said vertical and lateral penetrator elements.

2. The wellhead sidewall communications line penetrator arrangement of claim 1, wherein:

said communication line connector means of said first and other penetrator portions are constituted by respective electrical conductor wires.

3. The wellhead sidewall communication line penetrator arrangement of claim 2, wherein:

said connector means provided on said vertical and lateral penetrator elements for plugging these elements together with the penetrator passageway are constituted by respective multi-conductor coaxial electrical connectors.

4. A wellhead sidewall communications line penetrator arrangement for connecting an electrical cable within a well with an electrical cable outside the well, said penetrator arrangement comprising:

a tubing hanger having a first penetrator member that sealingly extends in a penetrator passageway within the tubing hanger from the axially lower end of the tubing hanger to the sidewall of the tubing hanger below the axially upper end of the tubing hanger;

the first penetrator member including an electrical cable means having a first connector accessable from the axially lower end of the tubing hanger for connection with said electrical cable with said well and a second connector recessed in the tubing hanger but accessable through the sidewall of the tubing hanger;

a tubing head having said tubing hanger received and mounted therein, said tubing head having a sidewall provided with a bore extending laterally therethrough;

a further penetrator member including an electrical cable means having a first connector at an inner end thereof and a second connector at an outer end thereof with an electrical cable means extending therebetween;

said further penetrator member being received in said tubing head lateral bore, and sealed with the tubing head intermediate the ends of said further penetrator member, with the said first connector thereof being plugged into said second connector of said first penetrator member and said second connector of said further penetrator member being disposed for access exteriorly of the tubing head;

said penetrator passageway including a vertical leg which intersects a lateral leg within the tubing hanger; and said first penetrator portion comprising a vertical penetrator element extending in the vertical leg of the penetrator passageway, and a lateral penetrator element extending only in the lateral leg of the penetrator passageway, the vertical and lateral penetrator elements being operatively plugged together within the penetrator passageway via connector means provided on each of said vertical and lateral penetrator elements.

* * * * *